US006283736B1

(12) United States Patent
Baptista et al.

(10) Patent No.: US 6,283,736 B1
(45) Date of Patent: Sep. 4, 2001

(54) HYDROSTATIC PUMP OR ENGINE WITH INFINITELY VARIABLE DEBIT OR IMPULSE

(76) Inventors: Fernando A. Baptista, Rua Pádua Correia, 30, P-4400 Vila Nova de Gaia (PT); João M. Pereira Dias Baptista, Urbanização da Cortinha, 6 - Cepães, 4740 Esposende (PT)

( * ) Notice: Subject to any disclaimer, the term of this patent is extended or adjusted under 35 U.S.C. 154(b) by 0 days.

(21) Appl. No.: 09/463,403

(22) PCT Filed: Jan. 15, 1999

(86) PCT No.: PCT/PT99/00002

§ 371 Date: Feb. 1, 2000

§ 102(e) Date: Feb. 1, 2000

(87) PCT Pub. No.: WO99/42727

PCT Pub. Date: Aug. 26, 1999

(30) Foreign Application Priority Data

Feb. 23, 1998 (PT) ..... 102121

(51) Int. Cl.[7] ..... F01C 21/16

(52) U.S. Cl. ..... 418/31; 418/137; 418/241; 418/138

(58) Field of Search ..... 418/31, 137, 138, 418/241

(56) References Cited

U.S. PATENT DOCUMENTS

| | | | | |
|---|---|---|---|---|
| 2,022,207 | * | 11/1935 | Kratzer | 418/137 |
| 2,159,941 | * | 5/1939 | Guinness | 103/136 |
| 3,143,079 | * | 8/1964 | Carner | 418/31 |
| 3,572,985 | * | 3/1971 | Runge | 418/138 |
| 3,807,912 | * | 4/1974 | Keller | 418/31 |

FOREIGN PATENT DOCUMENTS

| | | |
|---|---|---|
| 577016 | 5/1933 | (DE) . |
| 40 14 636 A1 | 7/1992 | (DE) . |
| 169836 | 10/1921 | (GB) . |
| 846549 | 8/1960 | (GB) . |

* cited by examiner

*Primary Examiner*—Charles G. Freay
*Assistant Examiner*—Eric Hayes
(74) *Attorney, Agent, or Firm*—Hoffman, Wasson & Gitler

(57) ABSTRACT

The invention refers to a hydrostatic pump or engine with infinitely variable debit or impulse of the rotative type, constituted by an external and fixed body (1) of cylindrical shape, and whose symmetry axis coincides with the axis (4) of the rotor (3); the named body is laterally fixed to two flat covers forming a case. A second body, or stator (2), with a cylindrical interior peripherical surface, and whose symmetry axis is in a coincident or parallel position with the rotor axis, is interposed at intervals between the rotor and the first body, being formed cameras (7) and (9), for the fluid circulation, and cameras (6) and (8), for the compensation and balance of forces acting in the interior and in the exterior of each stator side. Performing by means of rods (14), (15) the stator decentralization, in the direction (A) or in the inverse direction (B), one gets the progressive variation of the volume of the named cameras and consequently the variation of the debits or of the impulses in an infinitely variable way. Associating a pump sending fluid with an engine receiving the same fluid and this returning to the pump in continuous circulation, performing the stator decentralization, in one direction or in the inverse direction, in the pump or in the engine, or in both simultaneously, one gets a transmission of force or of speed, one or the other of infinitely variable value.

6 Claims, 1 Drawing Sheet

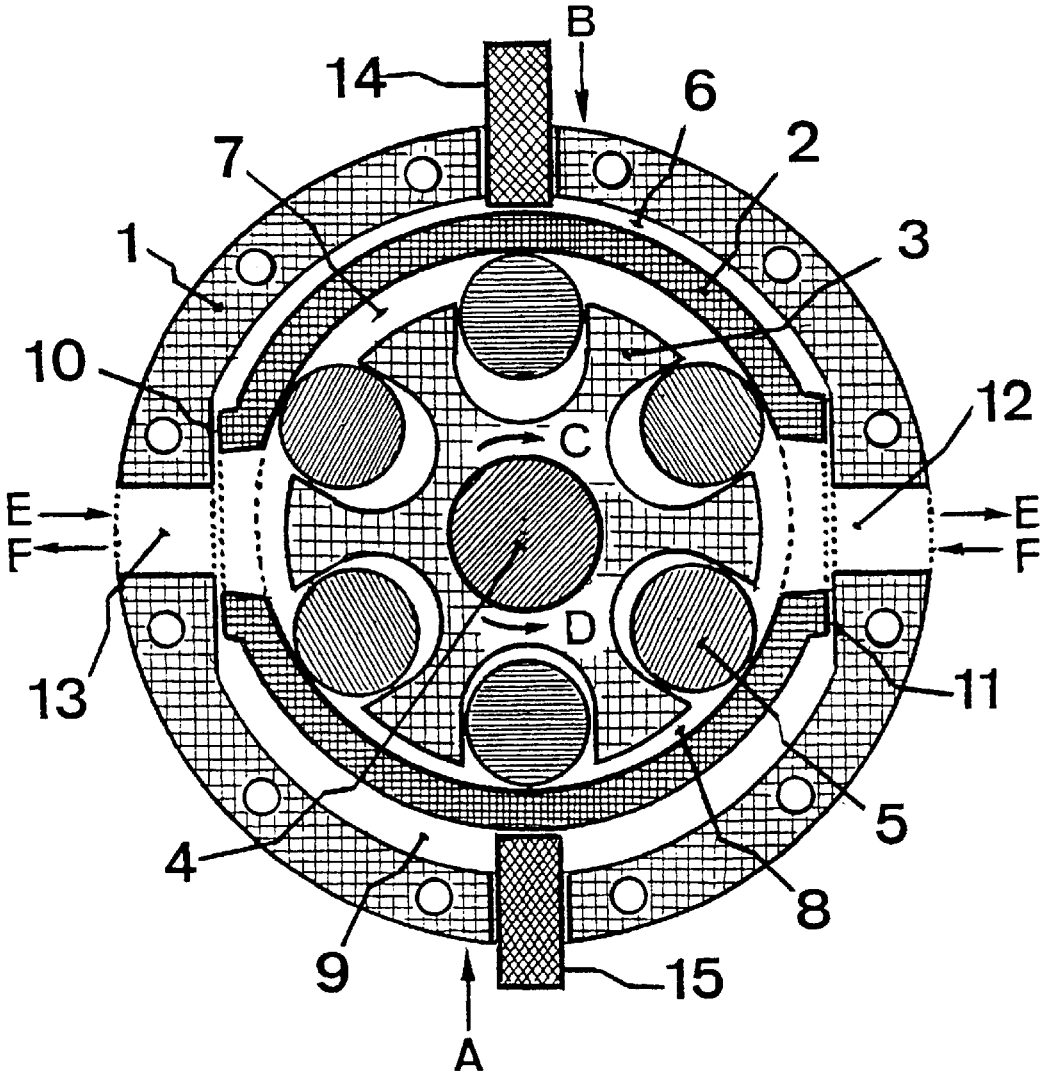
B
14
6
7
2
1
3
10
12
C
E
E
F
F
D
13
11
5
4
8
9
15
A

HYDROSTATIC PUMP OR ENGINE WITH INFINITELY VARIABLE DEBIT OR IMPULSE

DESCRIPTION

TECHNICAL DOMAIN

The present invention seeks to solve the difficulties one has to face in the application of hydrostatic pumps or engines with infinitely variable debit or impulse so that this type of equipment may be simpler in its functioning and in its making, resulting from it a lower cost on the one hand and the ability to widen its application to infinitely variable transmissions of speed and impulse.

PREVIOUS TECHNIQUE

The current technique of these equipments is based on an identical technique to the functioning of the alternative explosion engines using pistons, cylinders and valves.

The variation of the amplitude of depressions and impulses is obtained by varying the amplitude of the pistons course; for example, when the cylinders are grouped in a circle and in a parallel way, the variation of the amplitude of the pistons course is obtained by the variable inclination of a plate which acts in the pistons by their base, and with their return by means of a spring.

A great inconvience of this process is the great force that is necessary to be applied so that one may obtain the variation of the plate amplitude, which depends on the work pressure of the pistons.

EXPLANATION OF THE INVENTION

One goal of the invention is to solve this problem, i.e., to obtain a simple system of variation of amplitude whose command does not require the application of a great strength and, therefore, it is not dependent of the work pressures of the fluid. The basic idea of the invention is, in a pump or engine of the rotative type, to interpose, between the fixed stator and the rotor, a second stator, whose symmetry axis gets decentralized in relation to the rotor axis, and to obtain the balance of the pressures or of the depressions on each side of the stator.

The figure of the drawing represents in section a pump or an engine of the rotative type in which the movable and radial elements of the rotor are, for example, cylinders (5).

DESCRIPTION OF THE INVENTION

One of the ways of execution and functioning of the invention is described as follows, with reference to the drawings which represent only one way of performance.

As is verified in the drawing, this example of a pump or an engine with infinitely variable debit or impulse is constituted by a first external and fixed body whose internal surface is of cylindrical shape and whose symmetry axis coincides with the axis (4) of the shaft of the rotor (3). This shaft is supported in two flat and parallel covers, adjusted to the rotor faces and fixed in the faces of the first body, forming a case which closes the rotor at intervals.

A second body or stator (2) with a cylindrical interior peripherical surface and the partially cylindrical external one, and frontally adjusted to the above mentioned covers, is interposed in the named space, formed between the rotor and the internal part of the first body.

The stator moves in a direction (A) or in the inverse direction (B), i.e., it is decentralized in relation to the rotor axis and gets support and slides through the first body by means of two flat contacts situated in a parallel way and in diametrically opposite position, and in which the flat surface of each stator contact is adjusted to the flat surface of the contiguous contact of the external body (10), (11).

From the interposition of the stator between the external body and the rotor is derived the formation of intervailic spaces, external to the stator (6), (9) and internal to the stator (7), (8), which are also bounded by the lateral covers so as to form cameras. The cameras (7), (8), which encircle the rotor communicate with the fluid circuit by means of openings (12), (13), adjusted and contiguous to the sliding contacts so as to permit the fluid circulation.

The contiguous cameras to each side of the stator (6) and (7), (8) and (9), communicate between themselves by slots or orifices so as to permit the intercommunication and the fluid compensation, consequent to the variable decentralizations of the named stator, i.e., to their removing in a direction or in the inverse direction in relation to the rotor.

As a result of the reported intercommunication and fluid compensation, the balance of the acting pressures on each side of the stator is practically constant. Consequently it is of reduced value the force to be transmitted to the rod (14), (15), in order to be obtained the corresponding and easy decentralization of the stator.

The progressive decentralization of the stator produces a progressive variation of the cameras volume (7), (8), and without alteration of the direction of the rotor rotation, the direction of the fluid circulation results reversible according to the stator removal to one side (A) or to the opposite side (B) of the named rotor.

The value of the debit or impulse of the fluid which, in a given extent of decentralization is produced by the rotor rotation, corresponds to the difference between the volumetric values of cameras (7) and (8) internal to the stator, being this difference infinitely variable. It has zero value, when the stator is centered with the rotor, and a maximum value, when the stator is in the limit of the decentralization.

The constructive elements that were described and their operative way are identical in their application either as pump or as engine.

If the stator decentralization is performed, for example, in the direction indicated in (A) by means of the rod (15) the camera volume (7) increases and the camera volume (8) decreases; if the rotor rotation is in the direction (C), the fluid will circulate in the direction (E); if the rotor rotation is in the direction (D), the fluid will circulate in the inverse direction (F); if the decentralization is performed in the direction indicated in (B), the functioning relations will be identical but performed in the inverse direction of those of (A).

Associating a pump sending fluid with a receiving engine of the same fluid, and this returning to the pump in continual circulation: if one decanters the stator of the pump or of the engine, or both simultaneously, one will obtain a transmission of force and speed of progressive values, or infinitely variable.

This equipment has application in the movement of fluids and machines, transmission of force and speed, etc.

What is claimed is:

1. A hydrostatic pump, comprising an external body having an inner surface and an axis of symmetry an impeller rotor, said impeller rotor having a shaft, said shaft coinciding with said axis of symmetry, two parallel covers supporting said shaft, said covers fixed to said external body, a stator located between said rotor and said external body inner surface to form external chambers between said stator and said external body inner surface and internal chambers inside said stator, orifices in said stator for balancing the pressure in said internal and external chambers.

2. The hydrostatic pump of claim 1, further comprising rods controlling variation of amplitude of decentralization of said stator.

3. The hydrostatic pump of claim 1, wherein said stator has a cylindrical inner periphery and an external periphery formed by two half cylindrical surfaces.

4. The hydrostatic pump of claim 2 wherein said orifices allow fluid between said internal and external chambers in response to the variation of amplitude of decentralization of the stator.

5. The hydrostatic pump of claim 2, wherein said rods extend through the external body and have rectilinear movement.

6. The hydrostatic pump of claim 1, wherein said external body inner surface is cylindrical.

* * * * *